United States Patent [19]

Romagnoli

[11] Patent Number: 4,508,524

[45] Date of Patent: Apr. 2, 1985

[54] DEVICE FOR CENTERING THE PRINTING OF STRIP MATERIAL FOR THE AUTOMATIC PRODUCTION OF SMALL FILTER BAGS FOR INFUSION PRODUCTS

[75] Inventor: Andrea Romagnoli, San Lazzaro di Savena, Italy

[73] Assignee: IMA - Industria Macchine Automatiche S.p.A., Ozzano Emilia, Italy

[21] Appl. No.: 420,785

[22] Filed: Sep. 21, 1982

[30] Foreign Application Priority Data

Sep. 29, 1981 [IT] Italy ..... 3537 A/81

[51] Int. Cl.[3] ..... B32B 31/00

[52] U.S. Cl. ..... 493/11; 226/32; 226/34; 493/29; 493/34

[58] Field of Search ..... 493/11, 22, 24, 34, 493/199, 223, 29; 226/27, 28, 29, 32, 34, 35, 45; 83/365

[56] References Cited

U.S. PATENT DOCUMENTS

| | | | |
|---|---|---|---|
| 2,321,647 | 6/1943 | Brougham | 493/11 |
| 3,500,726 | 3/1970 | Lense | 493/11 |
| 3,537,359 | 11/1970 | Finke | 493/11 |

*Primary Examiner*—David Simmons

*Attorney, Agent, or Firm*—Karl F. Ross; Herbert Dubno

[57] ABSTRACT

A device for centering the printing of strip material, especially in apparatuses for feeding of such strip in the form of V-shaped labels capable of being associated with a continuous thread for use in machines for the automatic production of small filter bags for infusion products, in which said strip having printed motifs possesses, between said printed motifs, a recurring motif at a spacing equal to the length of the labels which are to be produced, and the feed means for such strip of said feed apparatus are constituted of two counter-rotating rollers having vertical axes, one of which is a following roller of resilient material and the other a driving roller of hard material having a driving surface of circular sector form for contact with the first roller. Said driving roller of circular sector form is rotatably mounted on a two-armed lever oscillating about a vertical axis, which lever, under an elastic action, encounters a screw-mounted element governed by electromagnetic actuating means subject to the control of means for reading and/or detecting the position of the recurring motifs between the printed motifs of the strip.

3 Claims, 7 Drawing Figures

FIG. 5
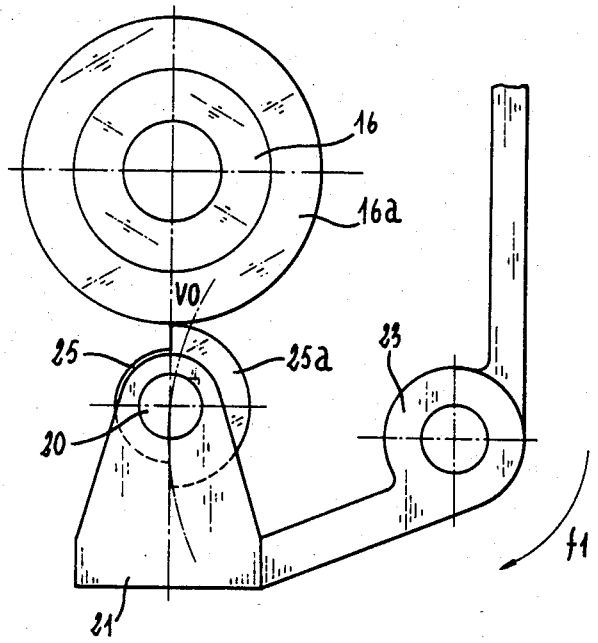
FIG. 6
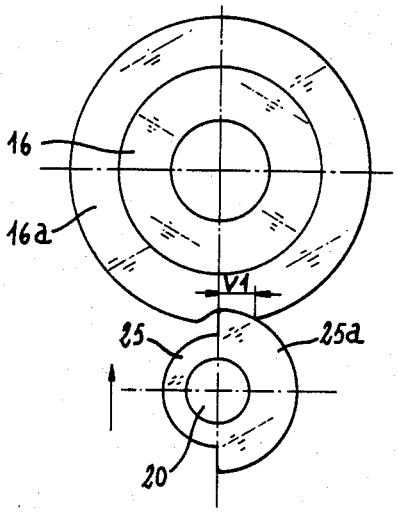
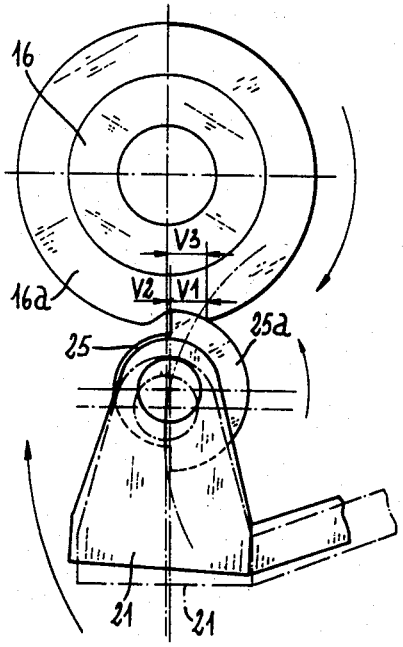
FIG. 7

DEVICE FOR CENTERING THE PRINTING OF STRIP MATERIAL FOR THE AUTOMATIC PRODUCTION OF SMALL FILTER BAGS FOR INFUSION PRODUCTS

DESCRIPTION

The present invention relates to a device for centering the printing of strip material, especially in apparatuses for feeding such strip in the form of single labels folded to V-shape and capable of being associated with a continuous thread for use in machines for the automatic production of small filter bags for infusion products.

From the American Patents, Ser. No. 685,031 of May 10, 1976 and Ser. No. 095,544 of Nov. 19, 1979, a small filter bag for infusion products, such as tea, camomile and the like, and a method of producing such a filter bag is known, and from the Italian Patents, Application No. 3341A/79 of Mar. 6, 1979 and No. 3339A/80 of Feb. 22, 1980, there are known a machine and an apparatus for the automatic actuation of said method for producing said filter bag.

In essence, said small filter bag is formed by folding, along a median line, a piece of filter paper lined on one face with a thin layer of thermoplastic material so as to form two mirror-image half-sections having the thermoplastic material lining mutually facing on the inside and by hot-sealing along the respective edges said two half-sections so as to constitute the space for containing the infusion product.

To a similar filter bag there is applied a suspension thread of natural fibres with an attached label by heating the zones of the filter paper in correspondence with said natural fibres thread on the opposite sides of said label disposed on one outer face of the bag in that the thread of natural fibres is folded parallel to itself so as to be reversed around the bag and placed upon the opposite face, and respectively in at least one zone of the latter face and in correspondence with the edges of said two half-sections of one side of the bag, between which there is inserted the end portion of said natural fibres thread, by causing a localized impregnation of the natural fibres thread itself with the thermoplastic material of the lining layer inside the bag, by diffusion through the filter paper consequent upon said heating action.

The connecting of the thread of natural fibres to the bag of filter paper produced in this way is sufficiently stable to assure proper handling of the bag in all the succeeding operations for treating the bag until it is made up into containers for sale to the consumer, while at the same time it is easily detached from the bag at the time of use by the said consumer without giving rise to any risk of tearing the filter paper of the small bag itself.

According to said apparatus, which is provided for the application of the suspension thread of natural fibres with attached label to the strip of filter paper in machines for the automatic production of small filter bags for infusion products, operating in combination with a feed device for labels, said strip which, as stated, is provided on one of its faces with a thin lining layer of thermoplastic material, is carried past and in front of said apparatus associated with the machine comprising means for feeding the continuous thread to the apparatus itself, which in turn comprises an intermittently rotating head or wheel having radial arms and means for applying the uniformly spaced labels to said thread ahead of said rotatable head or wheel, such that the thread pulled in motion by the same head or wheel with a label in correspondence with each of its arms is caused to pass across operative stations in which the thread is first cut behind the label, then folded parallel to itself and then joined to the strip by localized impregnation of the thread itself with the thermoplastic material of the lining layer of the strip diffusing through the filter paper consequent upon the action of the heating means. The labels to be applied at equal intervals along the natural fibres suspension thread, which normally have a form folded back on themselves into an upwardly open V, with printed motifs on the external faces and thermoplastic material on the faces internal to said V, are supplied to the application station of the machine by taking them singly from a store of a labels feed device, or by transferring them rhythmically in phase with said machine into said application station progressively as they are separated from a continuous strip of material for labels provided on its opposite faces with said printed motifs and said thermoplastic material respectively. In the latter case, for various reasons, and in particular as a consequence of the unreeling of the fed strip from its reeling bobbin, and also due to the inertial mass of the latter in intermittent motion, it occurs that the strip tends progressively to become delayed in its feed phase relative to the pitch or length of the label, with the result that the printed motif is no longer centered relative to the respective label separated from the strip.

To overcome the aforementioned disadvantage there is provided, as known, along said strip a motif, usually also printed, recurring between the printed motifs of the strip itself at a spacing equal to the length of the labels which are to be produced. In such a manner, by means of devices for reading and/or detecting the position of said motifs which recur between the printed motifs of the strip and therefore of the labels relative to a precise position of the station for separating the labels from the strip, that is by means of the so-called devices for centering the printing, it has become possible to eliminate said disadvantage which occurs by intervention on the feed movement of the strip itself.

The object of the present invention is that of providing a device for centering the printing of strip material, especially in apparatuses for the feeding of such strip in the form of V-shaped labels capable of being associated with a continuous thread for use in machines for the automatic production of small filter bags for infusion products, having a construction such as to exploit, as means for intervening in the feed movement of the strip, the resilience of the material of at least one of the two elements adapted for determining said feed movement of the strip and the displacement of the other of said two elements relative to the first in the direction of the feed movement itself of the strip and towards said first element.

Another object of the present invention is that of providing a construction for said printing centering device adapted for achieving the aforementioned objective and such as to enable its intervention action upon the feed movement of the strip to be varied in a gradual manner capable of being adjusted at every instant of said intermittent movement.

Yet another object of the present invention is that of providing a construction for said printing centering device adapted for achieving the aforementioned objectives and such as to be realized in an especially simple, efficient and economical manner having regard to the duties to be performed in combination with a machine for the production of small filter bags in a completely automatic manner at a high unit speed.

These and yet other objects which will become apparent below are all achieved with the device according to this invention for centering the printing of strip material, especially in apparatuses for the feeding of such strip in the form of V-shaped labels capable of being associated with a continuous thread for use in machines for the automatic production of small filter bags for infusion products, said strip with printed motifs possessing, between said printed motifs, a recurring motif at spacings corresponding to the length of the labels which are to be produced and said feed apparatus for said strip comprising means for folding the same strip into said upwardly open V-shape, means for causing said V-folded strip to be fed intermittently in correspondence with a cutting station for cutting the strip itself into single successive labels and means for reading and/or detecting the position of said recurring motif between the printed motifs of the strip and therefore of the cut labels relative to a precise position of said cutting station, which device is characterized by the fact that said means for causing the intermittent feeding of said V-folded strip in correspondence with said cutting station are constituted of two counter-rotating rollers having vertical axes, one of which, a following roller, is of resilient material while the other, a driving roller, is of a hard material having a driving surface, for contact with the first, of circular sector form, said circular sector driving roller being rotatably mounted on the end of one of the arms of a two-armed lever oscillating about a vertical axis, with the other arm of said oscillating two-armed lever encountering, under an elastic action, the free end of a screw-mounted locating element governed by the action of electromagnetic control means subject to the control of the aforementioned means for reading and/or detecting the position of said recurring motifs between the printed motifs of the strip and thus of said cut labels.

Other characteristics and advantages of the device for centering the printing according to the present invention will become more apparent from the detailed description which follows of one of its preferred forms of embodiment, given purely by way of example and in a non-limiting context, with reference to the attached drawings, in which.

Figure 3:
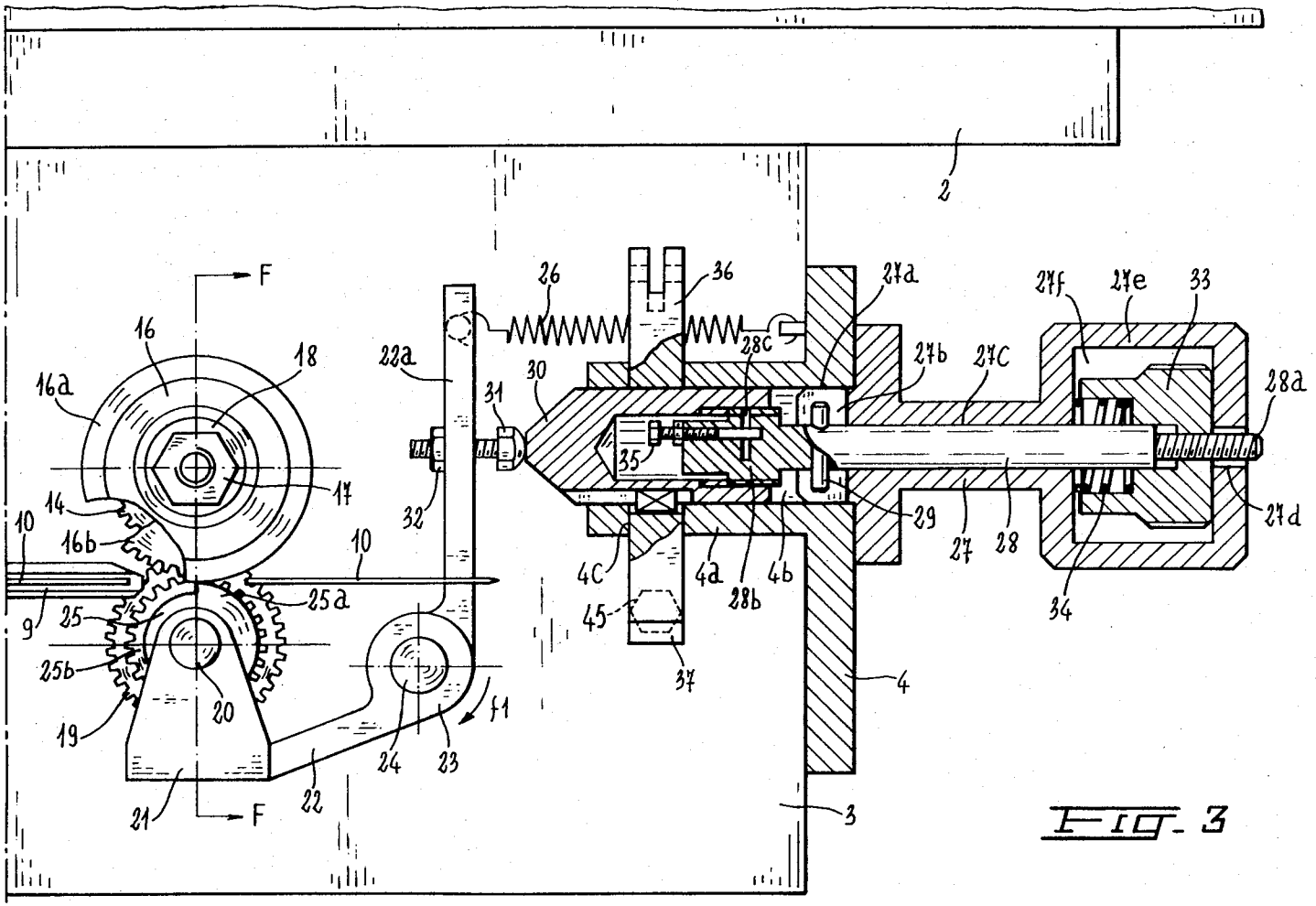
FIG. 3 is a plan view from above of said FIG. 2, with said printing centering device partially in section.
Figure 4:
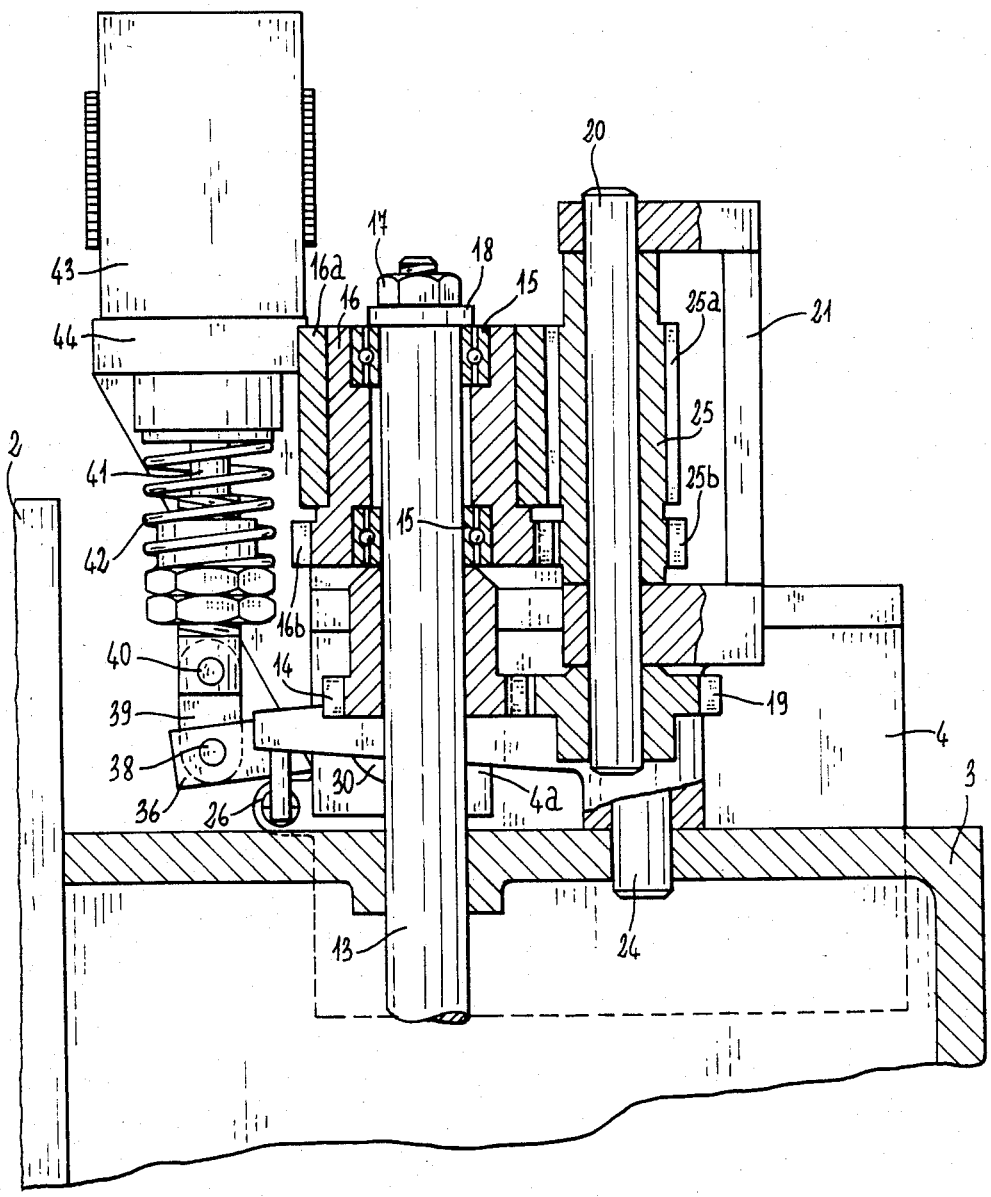

FIG. 4 is a sectional view in transverse elevation along the line indicated in FIG. 3 and looking in the direction of the arrows F—F shown in correspondence with said line; and FIGS. 5, 6 & 7 show diagrammatically in plan and to a larger scale, various functional positions of the means for feeding the strip for labels operating in conformity with the device for centering the printing according to the present invention.

Figure 1:
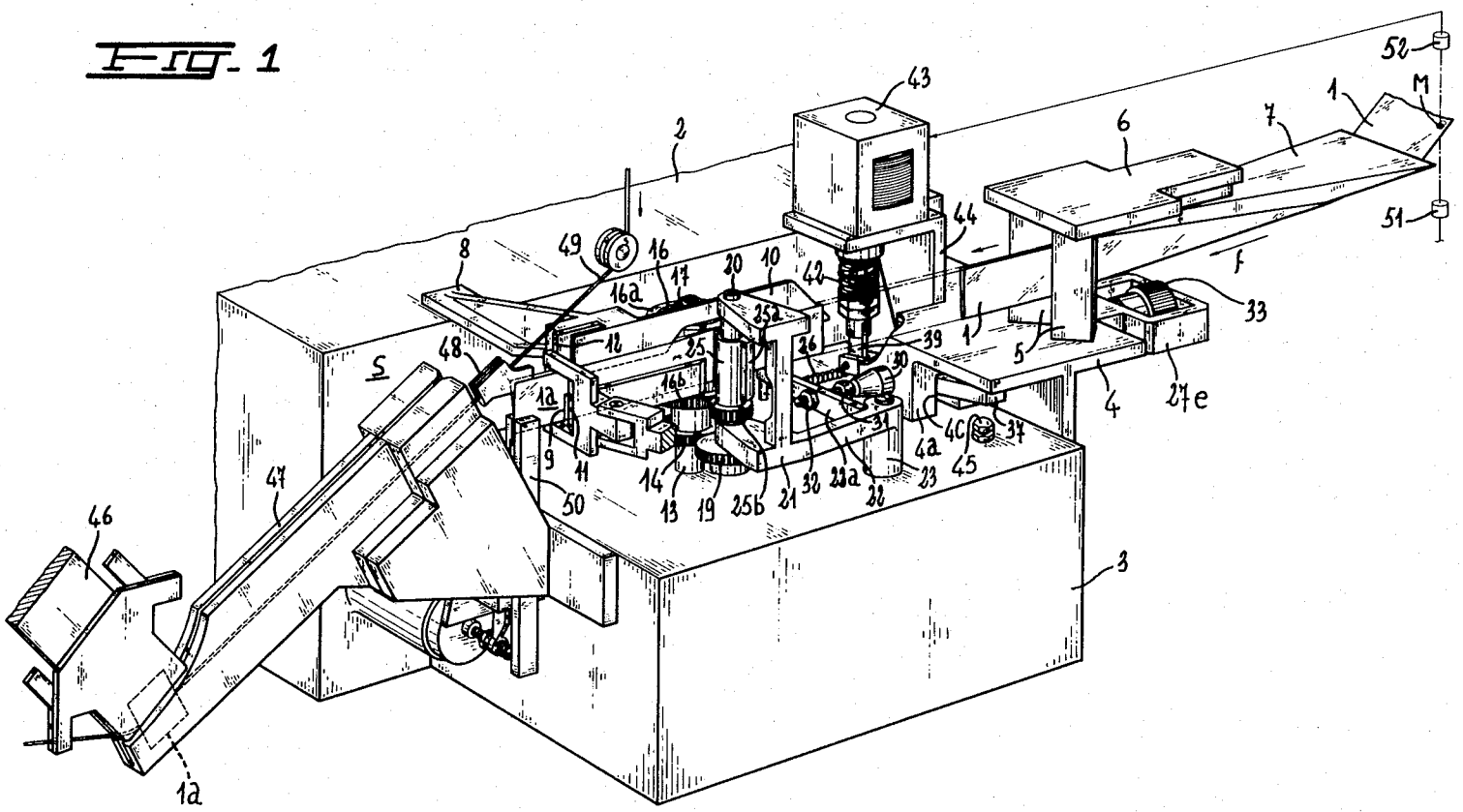
FIG. 1 shows a front perspective view of the feed apparatus for labels incorporating the centering device for the printing according to the present invention.

With reference to these Figures, and in particular first to FIG. 1, from which it is apparent that, of the machine and of the apparatus according to the aforementioned Italian Patents, there are illustrated only those parts which directly concern the feed apparatus for the strip 1 for labels including the printing centering device according to the present invention, from the same figures it can be seen also that, from the bed-plate 2 of said machine, there is supported in the manner of a table a casing 3 of said feed apparatus and from this casing a support element 4 of T-shape carrying, in turn, two pillars 5 of quadrangular section defining, with one mutually facing arris each, a passage for said strip 1, folded into an upwardly open V-shape, as will be seen below.

By the upper end of said mutually facing pillars 5 there is supported a plate 6, cantilevered towards the right as seen in FIG. 1, and carrying, also cantilevered towards the right and below it, a plate 7 tapering towards said pillars 5 both horizontally and vertically from the bottom upwards in the form of a folder element to cause the aforementioned folding of the strip 1 into a V-shape. At the left, still looking at said FIG. 1, there is supported from the aforementioned bed-plate 2 a support element 8, cantilevering above the casing 3 and terminating towards the bottom formed as a channel 9 in the plane of travel of the strip 1 and at the top in a plate element 10 above said channel 9, intended to be situated between the arms or flanks of said V-folded strip 1. In correspondence with the transverse, vertical plane in which the sides of said channel 9 terminate there operates a knife element 11 mounted on a U-shaped member turned through 90° towards the bed-plate 2 and alternately actuated by a known device, not illustrated here. Said sides of the channel 9 thus function with their vertical end edges as counter-knife element 12 for the knife element 11.

A shaft 13 (see also FIG. 4), motor-driven inside the casing 3 in phase with the machine from the inside of its bed-plate 2 and projecting vertically upwards above said casing 3 between said bed-plate 2 and the aforementioned plate 10, carries, keyed onto its portion above said casing 3, a gear wheel 14 and, above the latter, through the intermediary of roller bearings 15, a roller 16 held on said shaft 13 by means of the nut 17 and associated washer 18 and equipped with a sheath 16*a* of resilient material of known type. With said gear wheel 14 there engages a gear wheel 19 keyed in turn onto an axle 20, mounted overhung from the fork-shaped end 21 of one arm 22 of a two-armed lever 23 mounted freely pivoting on the vertical bolt 24 with which the horizontal, upper plate of the casing 3 is equipped (see also FIG. 3). Between the arms of said fork-shaped end 21, there is keyed onto said axle 20 a roller 25 of hard material having a contact surface with the roller 16–16*a* for driving the strip 1 as will be seen below, having a circular sector 25*a* (see in particular FIGS. 3, 5, 6 and 7). Said rollers 16–16*a* and 25–25*a* possess, in their lower part, a respective gear wheel 16*b* and 25*b*, meshing with each other.

Figure 2:
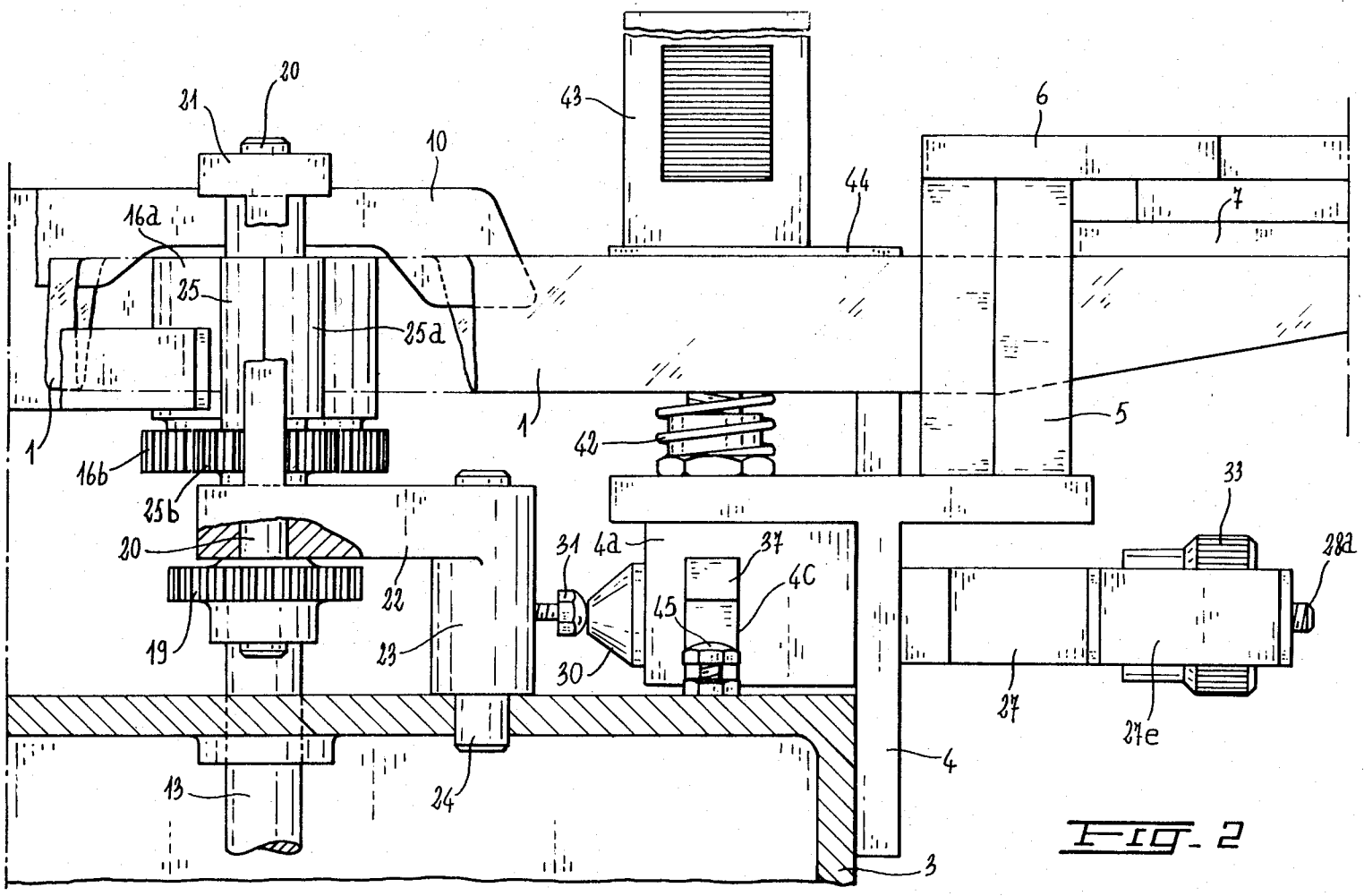
FIG. 2 shows a front elevation view of the part of said feed apparatus for labels which concerns said printing centering device.

At the free end of the other arm 22*a* of the aforementioned two-armed lever 23, there is anchored the end of a spring 26, the other end of which is anchored to the support element 4 of T-shape which, below its horizontal flange portion situated towards the aforementioned rollers 16–16*a* and 25–25*a*, possesses a thickening 4*a*, provided with a through bore 4*b* of horizontal axis, and a vertical slot 4*c* from the base upwards to close proximity with said horizontal flange portion (see FIGS. 2 and 3). Below the other part of said horizontal flange of the T-shaped support element 4, that is at the right looking at FIGS. 1, 2 and 3, there is provided a support element 27 fixed thereto in known manner and possessing a cylindrical portion 27*a* engaging into the aforementioned bore 4*b* and equipped with a diametral slot 27*b*.

Said support element 27 is axially bored as indicated at 27*c* and 27*d* coaxially with the through bore 4*b*, and terminates at its free end in a head 27*e*, hollow as indicated at 27*f*. In said bore 27*c* there is slidably engaged, as will be seen below, a pin 28 having an end portion with a threaded shank 28*a* projecting out of the cavity 27*f* of the head 27*e* through the bore 27*d* and a thickened, threaded portion at its other end 28*b* inside the bore 4*b*. In proximity to the thickened, threaded portion 28*b*, said pin 28 possesses a diametral small pin 29 engaging in the aforementioned diametral slot 27*b* possessed by the cylindrical portion 27*a* of the support element 27. On said thickened, threaded portion 28*b* of said pin 28 there is screw-mounted a ferrule stud 30, internally hollow and threaded at one end, while its other end projects out from the aforementioned thickened portion 4*a* of the support element 4 and is tapered or pointed so as to co-operate with a screw 31, mounted adjustable and blockable by means of the nut 32 in the form of a fixed locating element for the arm 22*a* of the pivoting two-armed lever 23. On the other end of the pin 28, inside the hollow 27*f* of the head 27*e* of the support element 27, there is screwed onto its threaded portion 28*a* an adjustment knob 33 under the action of a spring 34. The threaded portion 28*b* of the pin 28 is transversely slotted as indicated at 28*c* and a screw 35 is mounted perpendicularly to said transverse slot 28*c* and capable of being screwed into the head of said threaded portion 28*b*. By operating upon said screw 35, it is possible to eliminate any play which may exist between the turns of the threads of the stud 30 and of the threaded portion 28*b* of the pin 28, thus making the device for the centering of the printing more sensitive, as will be seen below according to the present invention.

In correspondence with the slot 4*c* possessed by the thickened portion 4*a* of the support element 4, two diametral arms 36 and 37 are associated in an axially slidable but non-rotatable manner with said stud 30 (see in particular FIG. 3).

At the end of the arm 36 there is articulated at 38 the end of a connecting rod 39, the other end of which is articulated at 40 to the end of the armature or core 41, around which a spring 42 is fitted, of an electromagnet 43 supported by a table element 44 fixed to the bed-plate 2. The end of the arm 37, on the other hand, is intended to come to bear against the locating spring 45 fixed to the upper, horizontal plane of the casing 3.

Behind or downstream of the knife 11 for cutting the strip 1 into labels 1*a*, there is provided the station S for the rhythmical transference of said labels 1*a* to the head or wheel having radial arms 46 in conformity with the apparatus according to the aforementioned Italian Patent. Of said station S there is shown (see FIG. 1) a channel structure 47 with thread guide 48 into which passes the thread 49 coming from a reel, not illustrated in said FIG. 1, of the machine according to the other of the aboveclaimed Italian Patents and the gripper device 50 for transferring said labels 1*a* from the above-described printing centering device according to the present invention to said station S for their application to said thread 49.

The printing centering device described above according to the present invention functions as follows:

A first adjustment to the position of the stud 30 having been carried out by hand rotation of the adjustment knob 33, in normal operating conditions of the device, the strip 1 is fed intermittently in the direction of the arrow f by the rollers 16–16*a* and 25–25*a* into a position of rest in the V-folded form between the knife 11 and the counter-knife 12, where it is rhythmically cut into labels 1*a* in phased synchronism with the taking of said labels by the gripper 50 for transferring said labels 1*a* to the station S for applying them to the thread 49 in accordance with that which is described in the aforementioned Italian Patents. In such normal conditions of operation of the device, the strip 1 is fed by said rollers 16–16*a* and 25–25*a* in mutual engagement relationship according to the arrangement illustrated in FIG. 5.

For the reasons stated above, the strip 1 tends to lag, leading to a phase shift of the printing in the labels 1*a* cut from the strip 1 until the reference motif M recurring between the printed motifs of the strip is no longer detected at each intermittent movement of the strip by the reading or detecting device constituted, for example, of a light source 51 and of a photoelectric cell 52, at which point, by means of said reading device, the electromagnet 43 is energized, which, acting through the arm 36, causes the stud 30 to rotate by screwing it onto the threaded portion 28*b* of the pin 28 so as to permit the spring 26 to cause the two-armed lever 23 to pivot in the direction of the arrow f1, thus pressing the circular sector portion 25*a* of the hard material roller onto the roller portion of resilient material 16*a*, anticipating the gripping of the strip 1 between said roller portions 25*a* and 16*a* and therefore lengthening the feed step of said strip 1, this occurring until the reading device again detects said recurring reference motif M.

With a thus constructed device, such an anticipation of the gripping of the strip 1 between the roller portions 25*a* and 16*a* can be caused to vary at any instant of the so-called machine cycle, from a value V0 as indicated in FIG. 5, to a value V3 as indicated in FIG. 7, by passing through a value V1 as indicated in FIG. 6, due to the simple compressing of the resilient material of the roller part 16*a*, and to a value V2 due to the pivoting movement of the two-armed lever 23 (see said FIG. 7).

As will be understood, the invention perfectly achieves the objectives set out and in particular that in relation to the possibility of varying the length of the feed step of the strip at any instant of the machine cycle to make possible the cutting of labels having printed motifs perfectly centered on the labels. In the practical operation of the above-described device according to this invention, it is, however, clearly possible to apply to it numerous modifications and variants such as, for example, that for shortening the step of the strip, in the case where this tends to anticipate, instead of to lag, in its feed phase relative to the step or length of the label, and moreover coming within the scope of the protective content of the invention itself as expressed in the following claims.

I claim:

1. Device for centering the printing of strip material, especially in apparatuses for the feeding of such strip in the form of V-shaped labels capable of being associated with a continuous thread for use in machines for the automatic production of small filter bags for infusion products, said strip with printed motifs possessing, between saidprinted motifs, a recurring motif at spacings corresponding to the length of the labels which are to be produced and said feed apparatus for said strip comprising means for folding the same strip into said upwardly open V-form, means for intermittently feeding said V-folded strip in correspondence with a cutting station for cutting the same strip into single, successive labels and means for reading and/or detecting the position of said recurring motif between the printed motifs of the strip and therefore of the cut labels at a precise position from said cutting station, characterized in that said means for intermittently feeding said V-folded strip in correspondence with said cutting station are constituted of two counterrotating rollers having vertical axes, of which one is a following roller of resilient material and the other a driving roller of hard material having a driving surface of circular sector form for contact with the first roller, said driving roller of circular sector form being rotatably mounted at the end of one of the arms of a two-armed lever pivoting about a vertical axis, with the other arm of said pivoting two-armed lever encountering, under an elastic action, the free end of a screw-mounted locating element governed by the action of electromagnetic control means subject to the control of the aforementioned means for reading and/or detecting the position of said recurring motifs between the printed motifs of the strip and therefore of said cut labels.

2. Device according to claim 1, characterized in that said locating element comprises a stud having its one end tapered and furnished at its other end with an internally threaded, cylindrical cavity and a pin having its opposite ends threaded, supported slidably but non-rotatably, said stud having an internally threaded cavity being screw-mounted onto one threaded end of said pin and a rotatable but non-slidable adjustment knob being mounted on the other end, the aforementioned stud possessing at least one radial arm, on which said actuating means with electromagnetic control act.

3. Device according to claim 2, characterized in that the threaded portion of said pin on which said tapered stud is screw-mounted is equipped with a transverse slot, a screw capable of being adjustably and blockably screwed in the head of said threaded portion of the aforementioned pin providing for the elimination of play between the turns of the threads of the aforementioned stud and of the aforementioned threaded portion of the pin itself.

* * * * *